US008851475B2

(12) United States Patent
Nordahl et al.

(10) Patent No.: US 8,851,475 B2
(45) Date of Patent: Oct. 7, 2014

(54) ELECTRONIC GAMING SYSTEM

(75) Inventors: Mats Nordahl, Göteborg (SE); Jimmy Eiterjord, Göteborg (SE)

(73) Assignee: Tangiamo AB, Gothenburg (SE)

( * ) Notice: Subject to any disclaimer, the term of this patent is extended or adjusted under 35 U.S.C. 154(b) by 892 days.

(21) Appl. No.: 12/591,204

(22) Filed: Nov. 12, 2009

(65) Prior Publication Data

US 2011/0111833 A1 May 12, 2011

(51) Int. Cl.

| | |
|---|---|
| ***G07F 17/32*** | (2006.01) |
| ***A63F 9/04*** | (2006.01) |
| ***G07C 15/00*** | (2006.01) |
| ***A63F 3/04*** | (2006.01) |
| *A63F 9/24* | (2006.01) |
| *A63F 7/26* | (2006.01) |

(52) U.S. Cl.

CPC ..... *A63F 9/0406* (2013.01); *G07C 15/008* (2013.01); *A63F 2300/1075* (2013.01); *G07F 17/3213* (2013.01); *A63F 3/0421* (2013.01); *A63F 2009/2457* (2013.01); *A63F 2009/241* (2013.01); *A63F 9/0468* (2013.01); *A63F 2009/2419* (2013.01); *A63F 7/26* (2013.01)

USPC ..... 273/145 C; 463/22; 273/146

(58) Field of Classification Search

USPC ..... 463/16–20; 273/146, 145 R, 144 R, 273/145 C, 145 CA, 144 A, 144 B

See application file for complete search history.

(56) References Cited

U.S. PATENT DOCUMENTS

| | | | | |
|---|---|---|---|---|
| 4,667,959 | A * | 5/1987 | Pfeiffer et al. | 273/149 R |
| 5,588,650 | A | 12/1996 | Eman et al. | |
| 6,083,105 | A | 7/2000 | Ronin et al. | |
| 7,815,187 | B2 * | 10/2010 | Yokota | 273/142 E |
| 8,079,593 | B2 * | 12/2011 | Nicely et al. | 273/145 CA |
| 2002/0113368 | A1 | 8/2002 | Hessing et al. | |
| 2007/0145680 | A1 * | 6/2007 | Rosenberg | 273/138.1 |
| 2008/0048394 | A1 * | 2/2008 | Lin | 273/144 R |
| 2008/0093798 | A1 * | 4/2008 | Yoshizawa | 273/146 |
| 2008/0108412 | A1 | 5/2008 | Snow et al. | |
| 2008/0246214 | A1 * | 10/2008 | Toyoda | 273/146 |
| 2009/0124348 | A1 | 5/2009 | Yoseloff et al. | |
| 2009/0143141 | A1 * | 6/2009 | Wells et al. | 463/37 |
| 2009/0264186 | A1 * | 10/2009 | Lai et al. | 463/22 |
| 2010/0069142 | A1 * | 3/2010 | Kido | 463/22 |
| 2011/0018194 | A1 * | 1/2011 | Nicely et al. | 273/145 CA |

OTHER PUBLICATIONS

International Search Report dated Feb. 10, 2011.
Written Opinion dated Feb. 10, 2011.

* cited by examiner

*Primary Examiner* — Bach Hoang
(74) *Attorney, Agent, or Firm* — Harness, Dickey & Pierce, PLC

(57) ABSTRACT

The present invention relates to a gaming system for providing a random number, comprising a touch screen, and a control unit connected to the touch screen, wherein the control unit is configured to identify a user movement on the touch screen corresponding to an activation signal for generating a random number, provide the activation signal to a random number generator, receive a random number from the random number generator, and display the random number on the touch screen, wherein the random number generator is an externally arranged hardware random number generator configured to receive a gambling device for generating the random number. Advantages with the invention include for example increased security in relation to manual operation of a dice game.

16 Claims, 2 Drawing Sheets

ELECTRONIC GAMING SYSTEM

FIELD OF THE INVENTION

The present invention relates to an electronic gaming system.

DESCRIPTION OF THE RELATED ART

Traditional games involving the use of one or a plurality of dice are well known. Also in the gambling environment, such as in a casino where games may be played for money, a multitude of different games are available in which different types of dice or similar gambling devices are used. Generally, one or a plurality of dice are rolled or shaken, and players are, under the supervision of one or more dealers, allowed wagering money on the outcome against each other or the bank.

However, the security of a game involving dice may sometimes be questioned, e.g. where one or a plurality of dice are replaced with a "loaded dice", favoring one result or the other. In order to improve such a game a number of different solutions have been proposed and an example of such an solution is disclosed in US 2009/0124348.

Specifically, US 2009/0124348 discloses an electronic video gaming system, where hand movement on a touch screen is used for initiating the virtual throwing of a virtual dice roll for providing a random number generation. However, even though the casino game according to US 2009/0124348 provides some improvements in relation to random generation of numbers for e.g. a game of Craps, the style of the game is changed effectively excluding users wanting to have an essential standard look and feel of a game of Craps, including for example the actual presence of a real dice.

Accordingly, it may for example be desirable to provide means for mimicking the standard look and feel while at the same time providing improvements to the generation of random numbers for e.g. a game of craps.

SUMMARY OF THE INVENTION

According to an aspect of the invention, the above is at least partly met by a gaming system for providing a random number, comprising a touch screen, and a control unit connected to the touch screen, wherein the control unit is configured to identify a user movement on the touch screen corresponding to an activation signal for generating a random number, provide the activation signal to a random number generator, receive a random number from the random number generator, and display the random number on the touch screen, wherein the random number generator is an externally arranged hardware random number generator configured to receive a gambling device for generating the random number.

By means of the invention, a user moving his hand over the touch screen will initiate the "motion" of a "real" gaming device, i.e. not a virtual one. More specifically, the user moving his hand over the touch screen will initiate the operation of a controllable externally arranged hardware random number generator that is used in conjunction with the gaming device for generating the random number that eventually will be displayed on the touch screen. An advantage with the invention includes the possibility to eliminate certain types of fraud committed by players, casino staff, or players and staff in collusion. Also, it may be possible to reduce the amount of resources casinos need to allocate to supervision in dealer controlled games of this kind. Additionally, in situations where the game result needs to be entered into an information processing system for storage or display purposes, it may be possible to increase game speed by automating this procedure instead of the dealer performing it manually.

Preferably, the externally arranged hardware random number generator is a dice-shaking device and the gambling device is a dice. By providing a dice and a controllable dice-shaking device in conjunction with the gaming system according to the invention, the user will experience a gaming scenario closely resembling the use of a real dice. However, as the dice-shaking device possibly may be provided away from the user, and not possible to manipulate by the user, an improved safety of the gaming system is provided.

Alternatively, the externally arranged hardware random number generator may be a roulette wheel and the gaming device may be a roulette ball. Furthermore, the externally arranged hardware random number generator instead also be an electronic card shuffler and the gaming device may be a playing card. Accordingly, different implementations may be possible in regards to the controllable externally arranged hardware random number generator for providing the random number.

In an embodiment, the user movement corresponding to the activation signal comprises detecting a disruption of user movement on the touch screen. Possibly, the user may move/slide his hand over the touch screen and the removal of his hand from the touch screen will initiate the activation of the hardware random number generator. The activation, and also the intensity the hardware random number generator will enforce on the gaming device may be depending on the intensity at which the user moves his hand over the touch screen. For example, a user moving his hand quickly back and forth over the touch screen may result in a large "shaking action" of the dice of the dice-shaking device.

For further enhancing the gaming experience, the random number being displayed on the touch screen may comprise displaying a visualization of the dice, wherein the random number corresponds to the number of pips of the dice facing upwards. Accordingly, an image (e.g. photo or video sequence) or a visualization of the dice present in the dice-shaking device may be shown on the touch screen. Preferably, an image or a visualization of the dice, corresponding to the dice in the dice-shaking device, may also be shown to the user already at the start of the process of generating the random number, e.g. by allowing the user to also move the image or the visualization of the dice back and forth over the touch screen for activating the dice-shaking device, effectively providing a direct feedback of the system. More specifically, if the user moves his hand over the touch screen, the image or visualization of the dice on the touch screen will correspond to the upward facing side of the dice within the dice-shaking device, including updating the image or visualization of the dice when the dice-shaking device shakes the dice.

In an advantageous embodiment of the invention, the dice-shaking device comprises the dice, shaking means, such as a wobbling surface, configured to be activated by the activation signal from the control unit for shaking the gambling device, and an image capturing device, such as a CMOS or a CCD camera, configured to acquire an image of the gambling device and to provide the acquired image to the control unit, wherein the control unit is further configured to recognize a symbol of the gambling device, and providing a result relating to the recognized symbol for display on the touch screen as the random number.

Preferably, a transparent enclosure, such as a glass bulb, is provided for enclosing the dice-shaking arrangement and the (one of plurality of) dice. This allows the user(s) to visually inspect the result of the dice, but without the possibility to manipulate the dice. Furthermore, by automatically recognizing the gambling device (e.g. the dice), the game may be more secure as well as it may be executed at a higher pace as compared to a manual gaming scenario.

In a preferred embodiment the shaking arrangement may be provided as a, possibly, integrated part of the inventive gaming system. Additionally, the gaming system may comprise a multi-user gaming interface for allowing a plurality of players to engage into for example a die game supported by the symbol recognition arrangement. The multi-user gaming interface may for example comprise a common touch sensitive surface for a plurality of users, in an embodiment comprising means for individual identification of the plurality of users. The multi-user gaming interface may also be a plurality of connected individual touch screens.

Additionally, by allowing for identification of individual users (e.g. comprising a first and a second user) it may be possible to allow the identification of the user movement corresponding to the activation signal to comprise detecting a transition of a control token from the first user to the second user, the control token provided for allowing generation of the activation signal. Accordingly, it may be possible for the first user at present designated to "roll the dice" to hand-over the designation (i.e. control token) to another user, e.g. the second user. This behavior is well known for example in relation to the dice game Craps, a dice game well suited for use in relation to the inventive gaming system. Further types of dice games are of course possible and in line with the general concept of the invention, including for example "Sic Bo" (also sometimes referred to as "Cussec", "Tai Sai", "Dai Siu", "Big and Small" or "Hi-Lo"), Fish-Prawn-Crab/Hoo Hey How, Grand Hazard/Chuck-a-Luck/Birdcage, and/or in relation to different possible side bets to other games, e.g. Double-Bet Roulette (e.g. additional betting options that for example create bets with higher odds than in ordinary roulette).

According to another aspect of the invention, there is provided a method for providing a random number using a gaming system comprising a touch screen, the method comprising identifying a user movement on the touch screen corresponding to an activation signal for generating a random number, providing the activation signal to a random number generator, receiving a random number from the random number generator, and displaying the random number on the touch screen, wherein the random number generator is an externally arranged hardware random number generator configured to receive a gambling device for generating the random number. This aspect of the invention provides similar advantages as according to the earlier mentioned aspect.

Further features of, and advantages with, the present invention will become apparent when studying the appended claims and the following description. The skilled addressee realizes that different features of the present invention may be combined to create embodiments other than those described in the following, without departing from the scope of the present invention.

BRIEF DESCRIPTION OF THE DRAWINGS

The various aspects of the invention, including its particular features and advantages, will be readily understood from the following detailed description and the accompanying drawings, in which.

DETAILED DESCRIPTION OF CURRENTLY PREFERRED EMBODIMENTS

Figure 1:
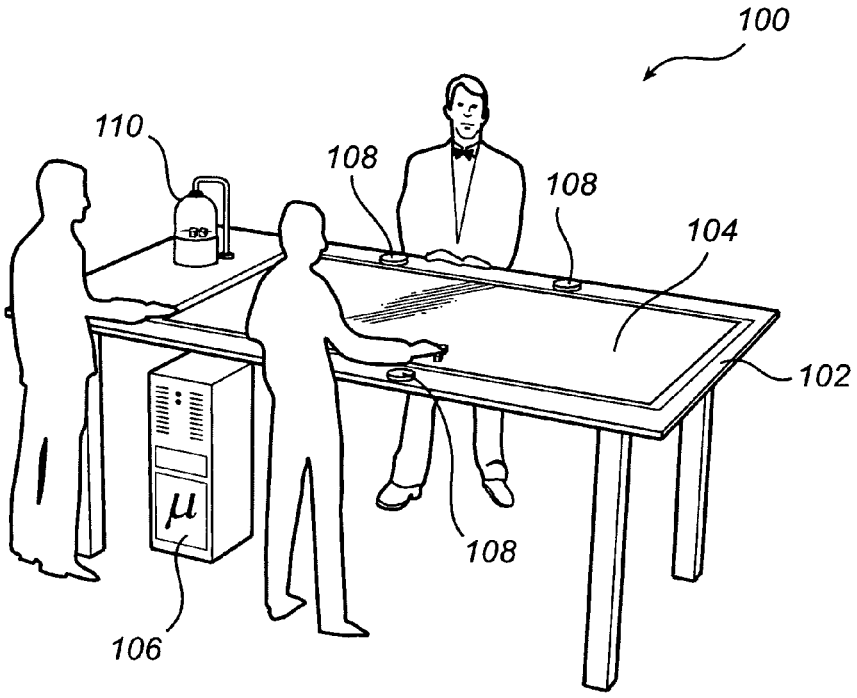
FIG. 1 is a conceptual block diagram illustrating a gaming system according to a currently preferred embodiment of the invention.

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled addressee. Like reference characters refer to like elements throughout.

Figure 2:
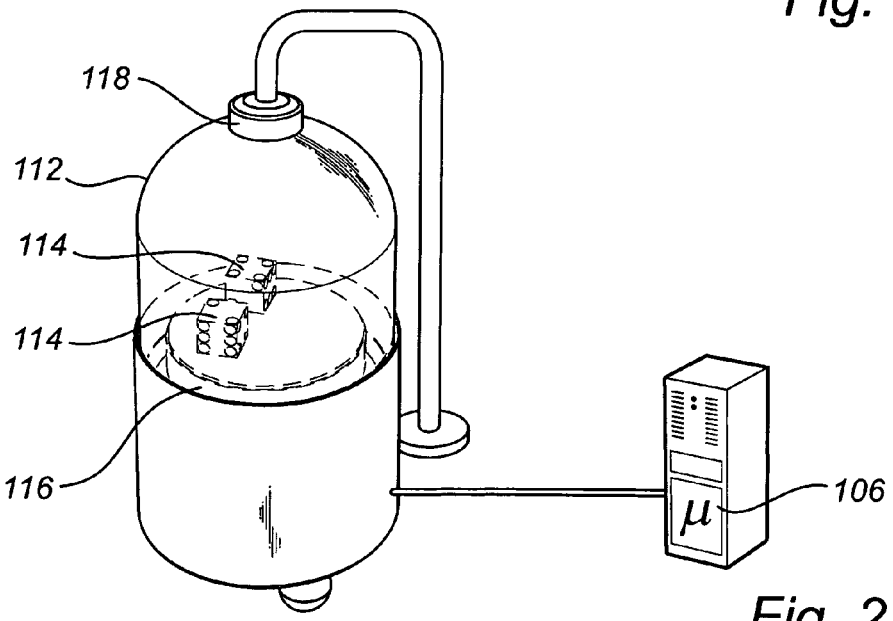
FIG. 2 is a flow chart illustrating exemplary processing steps performed by a control unit comprised with the gaming system.

Referring now to the drawings and to FIGS. 1 and 2 in particular, there is depicted a gaming system 100, comprising gaming table 102 including a multi-touch user interface and display 104 for one of a plurality of players. The display may for example be a dynamically configurable display, such as an LCD panel, connected to a control unit 106 for handling bets provided by the players.

The control unit 106 may include a microprocessor, microcontroller, programmable digital signal processor or another programmable device. The control unit 106 may also, or instead, include an application specific integrated circuit, a programmable gate array or programmable array logic, a programmable logic device, or a digital signal processor. Where the control unit includes a programmable device such as the microprocessor, microcontroller or programmable digital signal processor mentioned above, the processor may further include computer executable code that controls operation of the programmable device.

For allowing the different players to place bets, the multi-touch user interface and display 102 may comprise identification means 108 for differentiate the different users from each other. Such identification means 108 may comprise a multitude of sensors, and the results captured by the sensor may in turn be correlated for determining the identity of the user. The gaming system 100 further comprises a hardware-based random number generator in the form of a dice-shaking device 110.

In the illustrated embodiment the dice-shaking device 110 comprises a transparent cover 112 covering a plurality of dice 114, internally arranged means 116 in the dice-shaking device 110 for shaking the dice 114. The means 116 for shaking the dice 114 may for example include a mechanically wobbling surface that in turn shakes the dice 114.

The dice-shaking device 110 further comprises a symbol recognition arrangement 118 arranged at the top of the transparent cover 112. The symbol recognition arrangement 118 includes an image capturing device (not explicitly shown) such as a camera, for example comprising a CCD or a CMOS sensor. Additionally, for providing illumination that may be used by the image capturing device in capturing an image, the symbol recognition arrangement 118 may be provided with one or a plurality of light sources (not shown), such as a plurality of LEDs. The LEDs may emit light within a visible wavelength, but may also, or instead, emit light within with an infrared wavelength. Accordingly, the image capturing device may be provided with a filter for only allowing light within a specific, corresponding, wavelength range to be allowed to reach the capturing means of the image capturing device.

The connection between the symbol recognition arrangement 118 and the control unit 106 may be wireless, including for example an RF related transmission protocol, that may be encrypted. However, the connection between the symbol recognition arrangement 118 and the control unit 106 may also, or instead, be wired. Also the wired communication between the symbol recognition arrangement 118 and the control unit 106 may be encrypted.

Figure 3:
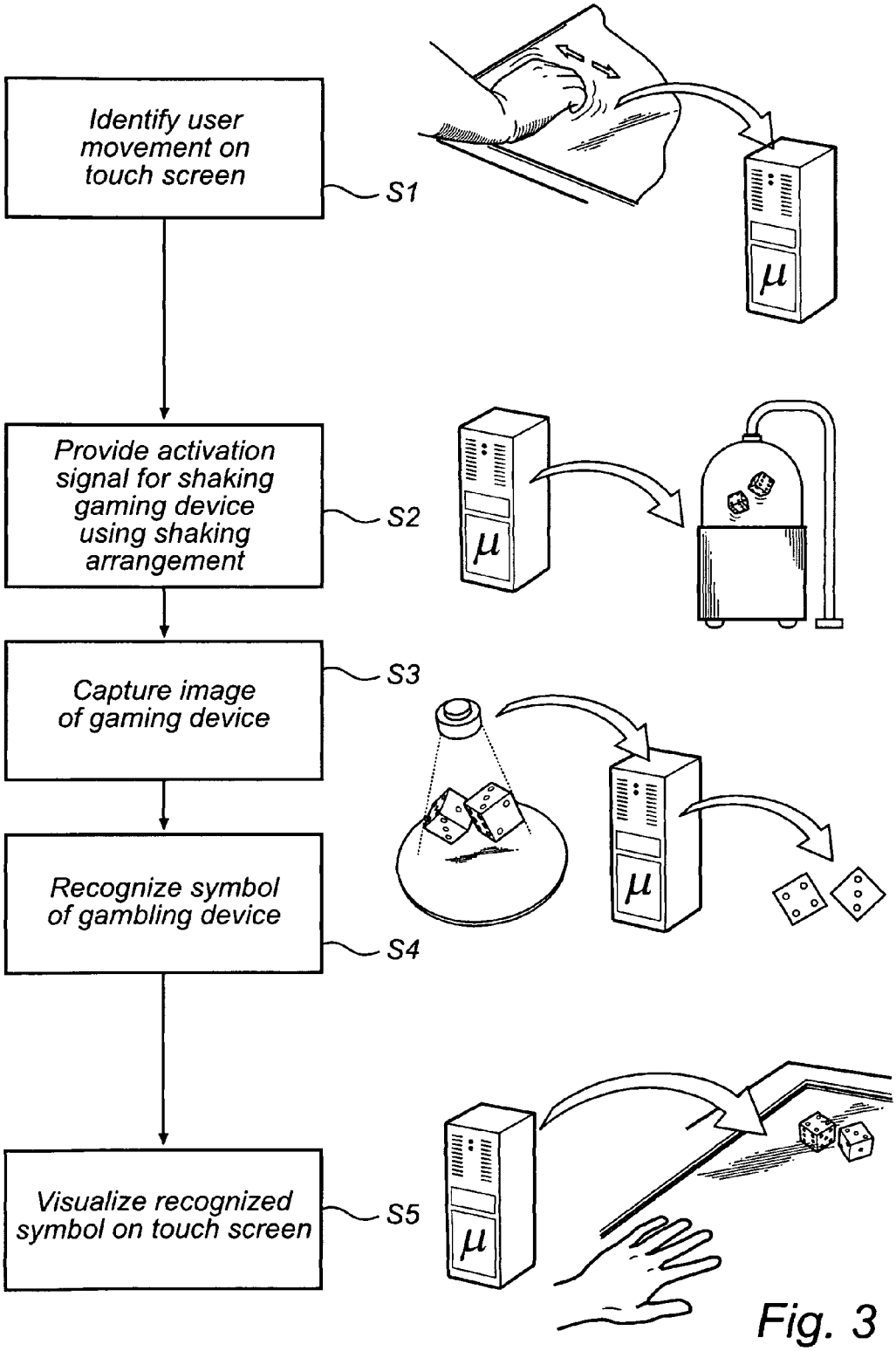
FIG. 3 illustrates a gaming system comprising a multi-user gaming interface and a dice-shaking device.

Turning now to FIG. 3, which shows a conceptual flow chart illustrating exemplary processing steps performed by the control unit 106 comprised with the gaming system 100. However, before the process starts, the multi-touch user interface and display 104 is arranged in a "start state", where the camera of the symbol recognition arrangement 118 captures live images of the dice 114 that are displayed on the multi-touch user interface and display 104. The dice 114 may e.g. be captured using the "Chroma key" technique (also sometimes referred to as greenscreen or bluescreen), such that it is possible to overlay a live image of the dice 114 on top of other content already being displayed on the multi-touch user interface and display 104. For example, the multi-touch user interface and display 104 may display the general setup for a Craps game, and the live images of the dice 114 being captured from within the dice-shaking device 110 may be displayed on top of the setup of the for the Craps game on the multi-touch user interface and display 104.

Following the start state, in a first step S1, a user movement on the multi-touch user interface and display 104 is identified. The identification may be done in correlation with the identification of a user, e.g. by means of the identification means 108, that is a user touching the identification means 108 with one hand and moving his hand on the multi-touch user interface and display 104 in the area where the live images of the dice 114 is displayed.

Based on the movement within the area of the dice 114 on the multi-touch user interface and display 104, an activation signal is provided, S2, such that the shaking means 116 of the dice-shaking device 110 is activated, thereby starting to shake the dice 114. At this point, it may be possible to continue to capture live images of the dice 114 within the dice-shaking device 110 and provide the live images overlaid onto the Craps setup in the area where the user is moving his hand. This will result in a direct feedback to the user, i.e. if the user moves his hand back and forth on the multi-touch user interface and display 104, the dice 114 will start to "shake" (changing the number of pips facing upwards) and the image of the dice 114 on the multi-touch user interface and display 104 will change in a similar manner. The user will accordingly get a feeling of shaking the real dice 114 even though the actual shaking takes place within the dice-shaking device 110. The intensity of the movement on the multi-touch user interface and display 104 may for example be used for controlling the intensity at which the shaking means 116 of the dice-shaking device 110 shakes the dice 114.

Depending on the type of game, a specific movement action of the user may result in e.g. "rolling the dice". In a Craps setup, the user is urged to roll the dice in the direction of an "outer edge" of the gaming table 102, such that the dice 114 hits the edge and rolls back onto the gaming table 102 again. According to an embodiment of the invention, the user may move his hand in a direction towards an edge of the gaming table 102, and thereafter remove his hand from the multi-touch user interface and display 104. This action may in turn activate an intense shaking action of the shaking means 116 such that random number relating to the dice 114 with great reliability may be provided. The continues process may be captured, S3, using the camera of the symbol recognition arrangement 118 for providing live images of the dice 114 when the dice 114 "rolls" over the multi-touch user interface and display 104, hits an edge, and rolls back onto the table again.

Using the symbol recognition arrangement 118, the random number of the dice 114 may be recognized, S4, i.e. the number of pips facing upwards. The symbol recognition arrangement 118 uses an image recognition algorithm configured to recognize a symbol of the dice 114 inside of the transparent cover 112. The image recognition algorithm may be specifically configured for different types of dice, e.g. gambling devices having different faces, including the pips of a normal cubical die. The image recognition algorithm may also be targeted to recognize different symbols of different gambling devices, such as non-cubical dice having more than six sides, and dice having symbols differing from the pips of normal dice 114. Using the recognized number of pips, i.e. the random number, it is possible to automatically calculate the result of e.g. the Craps game, meaning the results of the bets provided by the plurality of users using the multi-touch user interface and display 104. Accordingly, not only images of the dice 114 visualized, S5, on the multi-touch user interface and display 104 following the rolling of the dice 114, but the resulting random number may automatically be used for improving the speed and the safety of the game, as betting results automatically are determined and given to the users of the gaming system 100.

Even though the invention has been described with reference to specific exemplifying embodiments thereof, many different alterations, modifications and the like will become apparent for those skilled in the art. Variations to the disclosed embodiments can be understood and effected by the skilled addressee in practicing the claimed invention, from a study of the drawings, the disclosure, and the appended claims. For example, the above description of the invention has been given in relation to the display of live images of the dice 114 on the multi-touch user interface and display 104 being based on images captured of the dice 114 inside of the dice-shaking device 110. It should be noted that it may be possible to perform "live recognition" of the e.g. pips of the dice 114 facing upwards within the dice-shaking device 110, and provide a graphical rendering of the live recognition of the dice 114 on the multi-touch user interface and display 104. That is, random numbers resulting from shaking of the dice 114 within the dice-shaking device 110 may be used for providing virtual dice on the multi-touch user interface and display 104. It may also be possible to mix graphics and live images showing the dice 114 on the multi-touch user interface and display 104. As an example, it may be possible to show live images as long as the dice 114 are essentially still, and then introduce graphical renderings of the dice 114 when during rapidly changing dice 114.

Furthermore, in the claims, the word "comprising" does not exclude other elements or steps, and the indefinite article "a" or "an" does not exclude a plurality.

The invention claimed is:

1. A gaming system for providing a random number, comprising:

a touch screen;

an externally arranged hardware random number generator; and a control unit connected to the touch screen and the hardware random number generator, wherein the gaming system is configured to:

identify, by the control unit, a user movement on the touch screen corresponding to an activation signal for initiating generation of the random number;

provide, by the control unit, the activation signal to the random number generator to initiate the generation of the random number;

generate, by the hardware random number generator, the random number as a response to the user movement on the touch screen;

receive, by the control unit, the random number from the random hardware number generator in response to the activation signal; and display, by the control unit sending a signal to the touch screen, the random number on the touch screen, wherein the random number generator is configured to receive a gambling device for generating the random number, wherein the control unit is further configured to, during random number generation, display continuous, live images of the gambling device on the touch screen, the continuous, live images of the gambling device overlaying a displayed general setup of a game in an area where the user movement is on the touch screen and continuing to display the continuous, live images of the gambling device after the user movement is no longer detected.

2. The gaming system according to claim 1, wherein the externally arranged hardware random number generator is a dice-shaking device and the gambling device is a dice.

3. The gaming system according to claim 1, wherein the externally arranged hardware random number generator is a roulette wheel and the gaming device is a roulette ball.

4. The gaming system according to claim 1, wherein the externally arranged hardware random number generator is an electronic card shuffler and the gaming device is a playing card.

5. The gaming system according to claim 1, wherein identifying the user movement corresponding to the activation signal comprises detecting a disruption of user movement on the touch screen.

6. The gaming system according to claim 1, further comprising determining a user movement intensity and providing the user movement intensity to the externally arranged hardware random number generator, wherein the generation of the random number depends on the user movement intensity.

7. The gaming system according to claim 1, wherein displaying the random number comprises displaying a visualization of a dice on the touch screen, wherein the random number corresponds to the number of pips of the dice facing upwards.

8. The gaming system according to claim 7, wherein the visualization of the dice is provided adjacently to the user movement on the touch screen.

9. The gaming system according to claim 7, wherein identifying the user movement comprises displaying the visualization of the dice on the touch screen and detecting the user movement in a visualization area corresponding to the visualization of the dice.

10. The gaming system according to claim 1, wherein the externally arranged hardware random number generator comprises:

the gambling device;

shaking means configured to be activated by the activation signal from the control unit for shaking the gambling device; and an image capturing device configured to acquire an image of the gambling device and to provide the acquired image to the control unit, wherein the control unit is further configured to:

recognize a symbol of the gambling device; and providing a result relating to the recognized symbol for display on the touch screen as the random number.

11. The gaming system according to claim 10, wherein the image capturing device is at least one of a CMOS and a CCD camera.

12. The gaming system according to claim 1, further comprising a multi-user gaming interface.

13. The gaming system according to claim 12, wherein the multi-user gaming interface comprises a common touch sensitive surface for a plurality of users.

14. The gaming system according to claim 12, wherein the multi-user gaming interface further comprises means for individual identification of the plurality of users.

15. The gaming system according to claim 10, wherein the control unit is further configured to detect a first and a second user, and wherein identifying the user movement corresponding to the activation signal comprises detecting a transition of a control token from the first user to the second user, the control token provided for allowing generation of the activation signal.

16. A gaming system for providing a random number, comprising:

a touch screen;

an externally arranged hardware random number generator; and a control unit connected to the touch screen and the hardware random number generator, wherein the gaming system is configured to:

identify, by the control unit, a user movement on the touch screen corresponding to an activation signal for initiating generation of the random number;

provide, by the control unit, the activation signal to the random number generator to initiate the generation of the random number;

generate, by the hardware random number generator, the random number as a response to the user movement on the touch screen;

receive, by the control unit, the random number from the hardware random number generator in response to the activation signal; and display, by the control unit sending a signal to the touch screen, the random number on the touch screen, wherein the random number generator is configured to receive a gambling device for generating the random number, wherein the control unit is further configured to, during random number generation, display continuous, live images on the touch screen corresponding to movements of the gambling device, the continuous, live images of the gambling device overlaying a displayed general setup of a game in an area where the user movement is on the touch screen and continuing to display the continuous, live images of the gambling device after the user movement is no longer detected.

* * * * *